United States Patent [19]

Jeffrey

[11] 4,371,019

[45] Feb. 1, 1983

[54] MOBILE LOG SPLITTING APPARATUS

[76] Inventor: Michael J. Jeffrey, 1430 Stewart Rd., Hudson, Mich. 49427

[21] Appl. No.: 180,518

[22] Filed: Aug. 25, 1980

[51] Int. Cl.[3] ..... B27L 7/00

[52] U.S. Cl. ..... 144/193 A; 144/3 K

[58] Field of Search ..... 144/3 K, 193 R, 193 K, 144/242 R

[56] References Cited

U.S. PATENT DOCUMENTS 4,076,061 2/1978 Greeninger ..... 144/193 E 4,173,237 11/1979 Heikkinen et al. ..... 144/193 A 4,269,242 5/1981 Smith et al. ..... 144/192

*Primary Examiner*—W. D. Bray

*Attorney, Agent, or Firm*—Malcolm R. McKinnon

[57] ABSTRACT

A self-contained, mobile log splitting apparatus incorporating improved means for automatically splitting logs of various diameters, the apparatus including an internal combustion engine and novel hydraulically actuated means for splitting logs whereby the apparatus may be operated in remote areas where conventional sources of power are unavailable.

23 Claims, 8 Drawing Figures

FIG. 5.
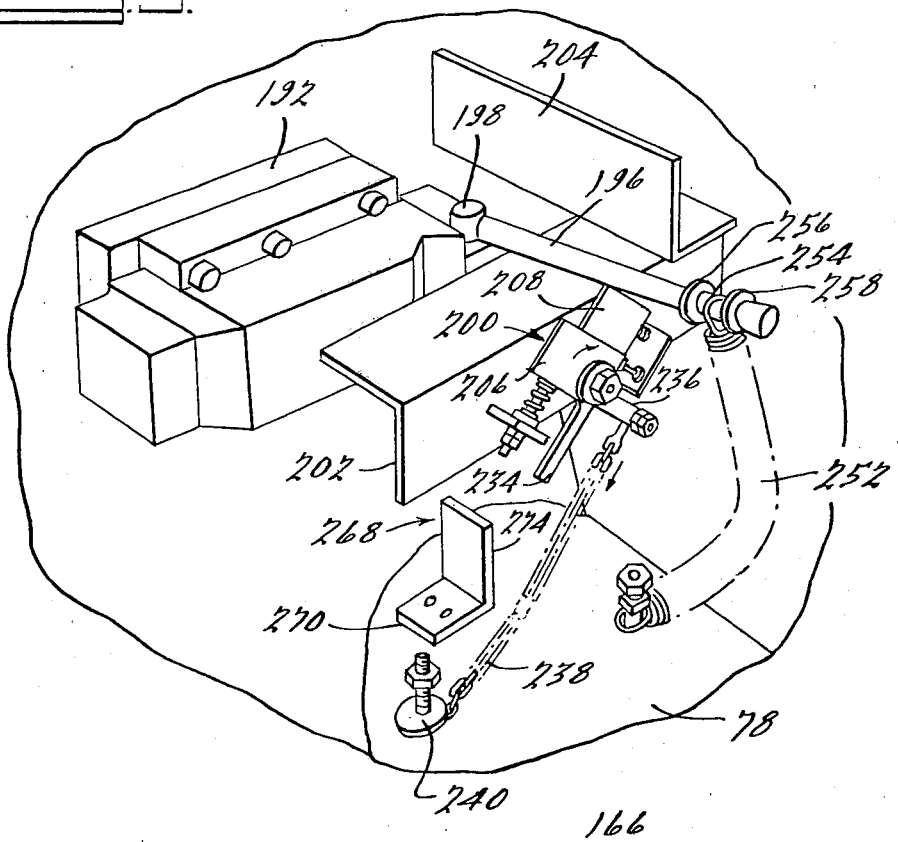
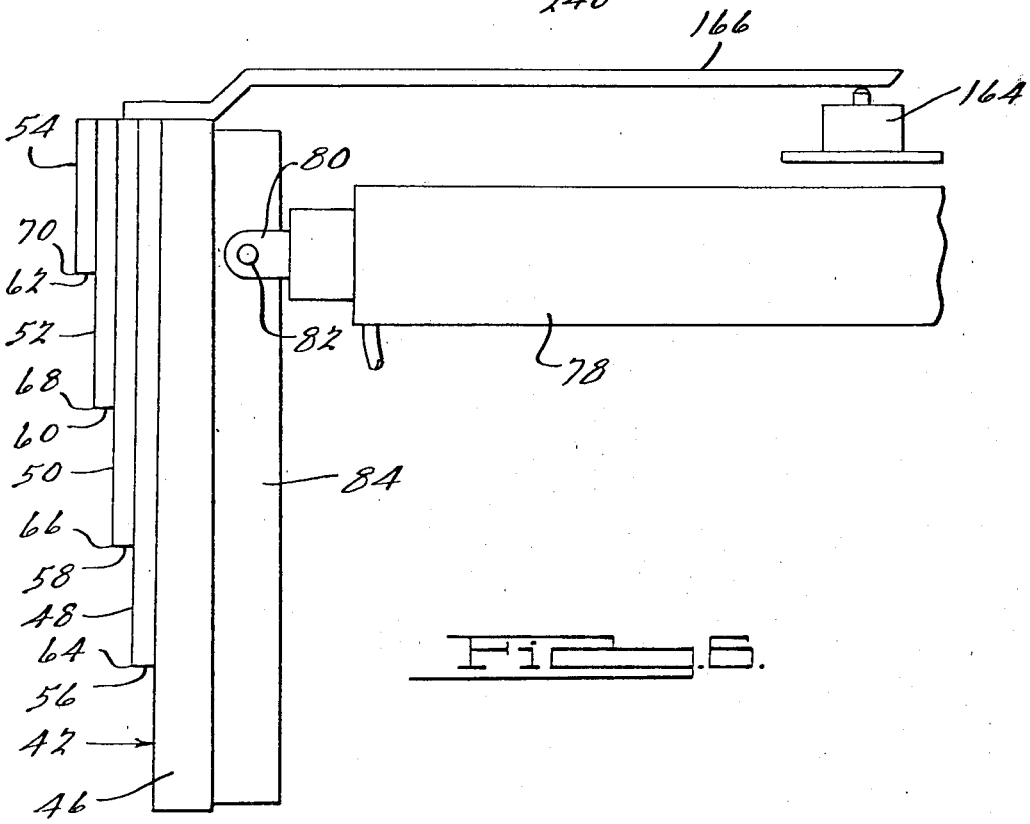
FIG. 6.

MOBILE LOG SPLITTING APPARATUS

BRIEF SUMMARY OF THE INVENTION

This invention relates to log splitting apparatus and, more particularly, to an improved self-contained, mobile log splitting apparatus particularly adapted for use in remote areas where conventional sources of power are unavailable. Heretofore, many types of devices have been provided for splitting logs. Many of these prior devices require auxiliary sources of power and/or are designed for substantially permanent installation which precludes the use thereof in remote areas, such as in forests, where conventional sources of power, such as electrical power, are unavailable. Many other prior devices of the indicated character are either too expensive and/or are lacking in versatility and/or have other deficiencies that preclude practical application of the devices in the field.

An object of the present invention is to overcome the aforementioned as well as other disadvantages in prior log splitting devices and to provide an improved mobile log splitting apparatus incorporating improved means for automatically splitting logs.

Another object of the invention is to provide an improved log splitting apparatus that may be utilized in remote areas where conventional sources of power are unavailable.

Another object of the present invention is to provide an improved mobile log splitting apparatus that may be readily adjusted to accommodate logs of widely varying diameters.

Another object of the present invention is to provide an improved mobile log splitting apparatus that may be moved on highways and other roads without requiring special permits.

Another object of the present invention is to provide an improved mobile log splitting apparatus incorporating improved means for hydraulically feeding and driving logs against an adjustable multiple wedge splitting head.

The above as well as other objects and advantages of the present invention will become apparent from the following description, the appended claims and the accompanying drawings.

BRIEF DESCRIPTION OF THE DRAWINGS

FIG. 5 is a perspective view of the hydraulic ram reversing valve means embodied in the apparatus illustrated in FIGS. 1, 2 and 3;

FIG. 6 is a side elevational view, with portions broken away, of the novel log drive member and associated mechanisms embodied in the apparatus illustrated in FIGS. 1, 2 and 3;

DETAILED DESCRIPTION

Figure 2:
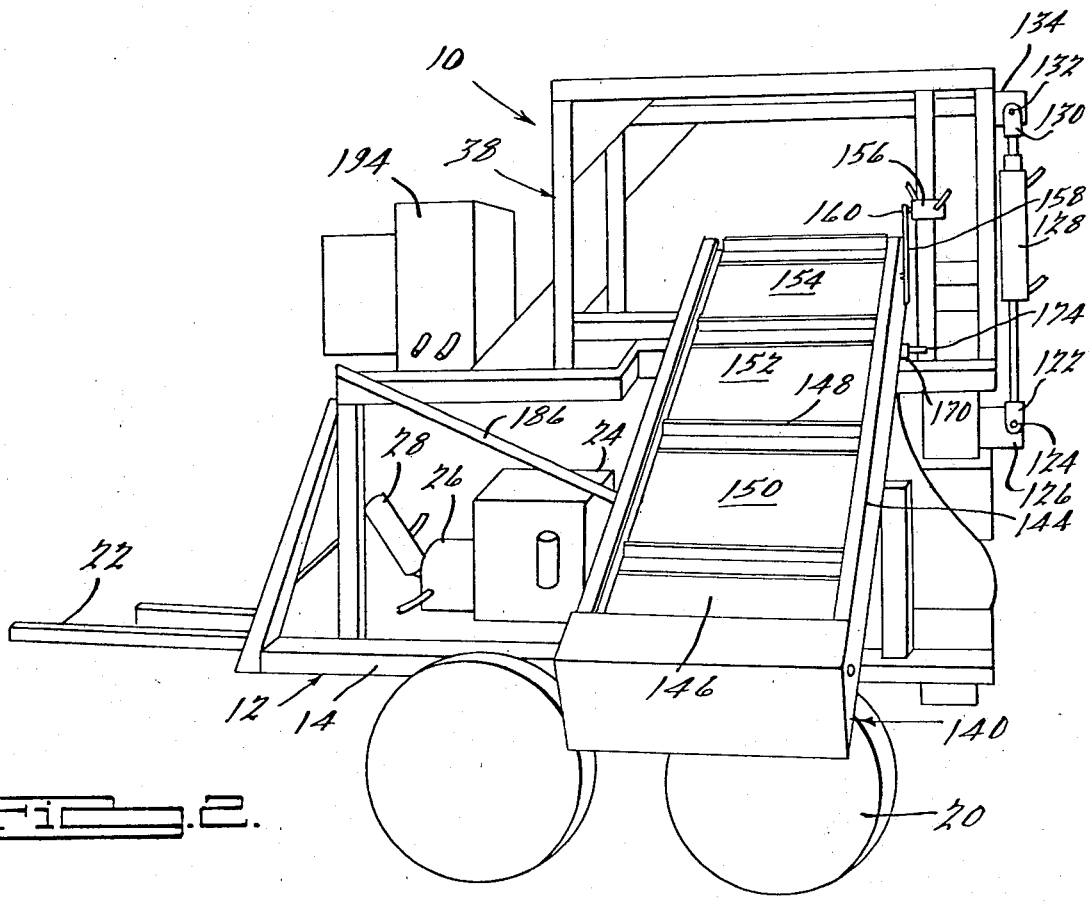
FIG. 2 is a side elevational view of the apparatus illustrated in FIG. 1.

Referring to the drawings, a mobile log splitting apparatus, generally designated 10, embodying the present invention is illustrated therein and is comprised of a chassis, generally designated 12, which includes spaced, longitudinally extending side members, such as 14, joined by spaced cross members, such as 16 and 18, to form a unitary structure. The chassis 12 is mounted on four wheels, such as 20, in a conventional manner and is provided with a conventional trailer tongue 22 whereby the log splitting apparatus 10 may be attached, for example, to a pickup truck, tractor or other prime mover and transported to a desired location. As shown in FIG. 2, a conventional internal combustion engine, such as a gasoline or diesel engine, schematically illustrated at 24, is mounted on the chassis 12. The engine 24 is adapted to power a conventional hydraulic pump, schematically illustrated at 26 which supplies hydraulic fluid under pressure through a hydraulic accumulator 28 to various hydraulically actuated power devices incorporated in the apparatus 10 as will be described hereinafter in greater detail.

An open top, generally V-shaped guide chute 30 is provided which is mounted on the chassis 12 and which extends longitudinally thereof, the guide chute 30 being comprised of a pair of inclined side walls 32 and 34 which are supported at the apex of the V by a longitudinally extending stringer 36 provided on the chassis 12. The side walls 32 and 34 are also supported by a framework, generally designated 38 carried by the chassis 12 and by buttresses, such as 40 which extend between the side walls and the framework 38.

Figure 1:
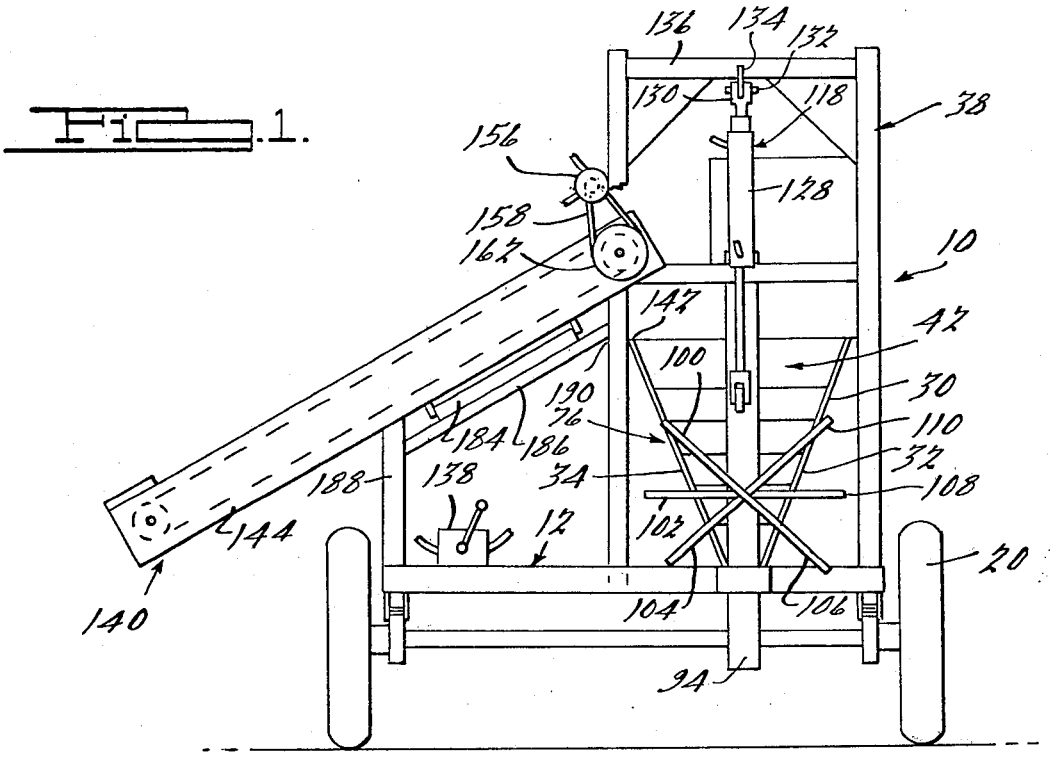
FIG. 1 is an end elevational view of a self-contained, mobile log splitting apparatus embodying the present invention.
Figure 3:
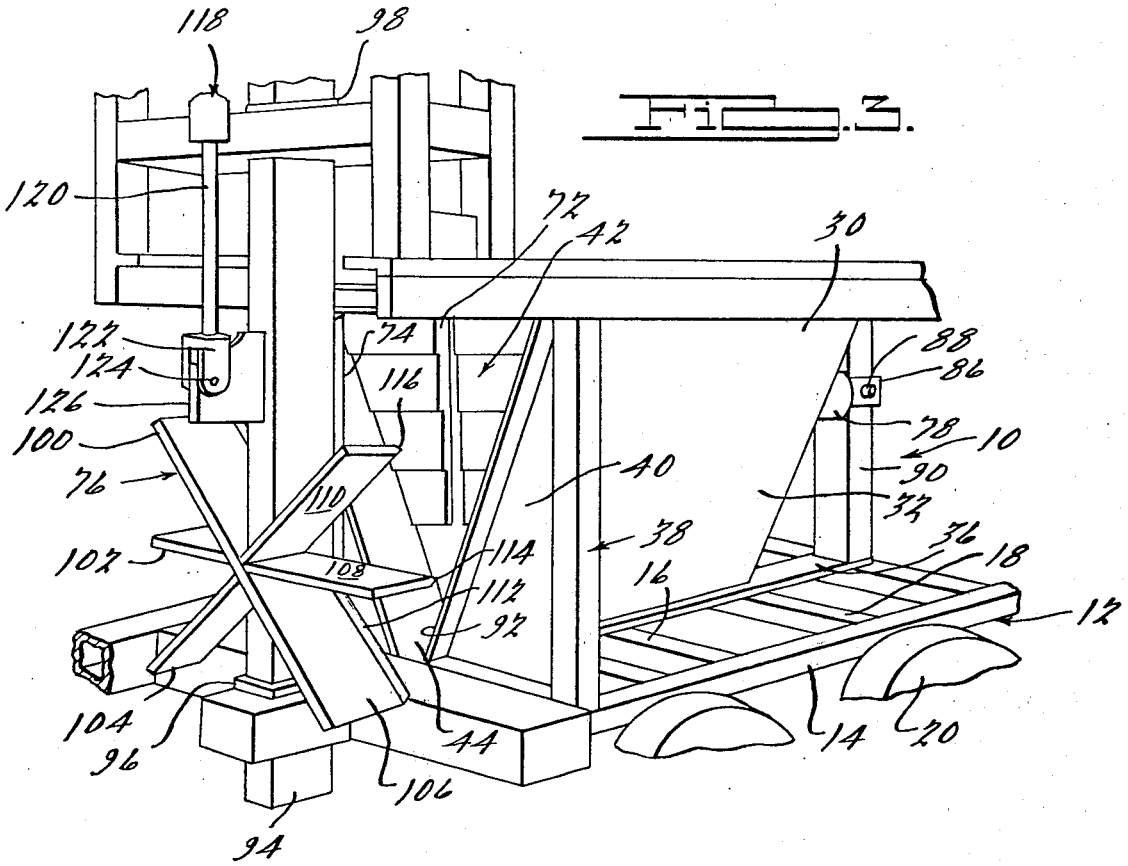
FIG. 3 is an enlarged perspective view, with portions broken away, of the apparatus illustrated in FIGS. 1 and 2.

A drive member, generally designated 42, is provided which is also generally V-shaped in front elevational view and which is mounted for reciprocal movement in the generally V-shaped passageway 44 defined by the side walls 32 and 34 of the chute 30. As shown in FIGS. 1, 3 and 6, in the embodiment of the invention illustrated, the drive member 42 is of laminated, stepped configuration and is comprised of a generally V-shaped base plate 46 and generally trapezoidal shaped plates 48, 50, 52 and 54 which are fixed together, as by welding, and which are of progressively descreasing height whereby the plates 48, 50, 52 and 54 which are laminated together and to the base plate 46 provide horizontal abutment surfaces 56, 58, 60 and 62 terminating in relatively sharp edges 64, 66, 68 and 70, respectively, the horizontal abutment surfaces and associated sharp edges being adapted to engage the trailing end of a log during the log splitting operation to prevent the log from tilting upwardly as it is being split. A vertically extending groove 72 is also provided in the central portion of the drive member 42, the groove 72 being adapted to receive a vertically extending splitting wedge 74 provided on a multiple wedge splitting head, generally designated 76, which will be described hereinafter in greater detail. The drive member 42 is adapted to be reciprocated in the passageway 44, defined by the side walls 32 and 34 of the chute 30, through the agency of a hydraulic ram 78, one end portion of which is fixed to the drive member 42 by a clevis 80 and pin 82 which extends through a vertically extending backing beam 84 fixed to the central portion of the plate 46 on the side thereof opposite the trapezoidal plates as illustrated in FIG. 6. The opposite end of the hydraulic ram 78 is fixed by a clevis 86 and pin 88 to a vertically extending beam 90 which forms a part of the framework 38.

In the embodiment of the invention illustrated, the multiple wedge splitting head 76 is mounted on the chassis 12 and the framework 38 adjacent the exit end 92 of the chute 30. The splitting head 76 is comprised of an elongate, vertically extending rectangular beam 94 which is mounted for vertical movement in vertically spaced bearings 96 and 98 carried by the chassis 12 and framework 38, respectively. A plurality of angularly spaced, generally radially extending splitting wedges 100, 102, 104, 106, 108 and 110 are provided the inner end portions of each of which are fixed, as by welding, to the beam 94 as illustrated in FIGS. 1 and 3. The vertically extending splitting wedge 74 is also fixed to the central portion of the side of the beam 94 adjacent the exit end 92 of the chute 30, the pointed edge of the wedge 74 being disposed in a plane spaced outwardly (toward the drive member 42) from the plane of the pointed edges, such as 112, 114 and 116, provided on the angularly disposed splitting wedges 106, 108 and 110, respectively.

Means is provided for vertically moving the splitting head 76 so as to adjust the vertical position of the head 76 relative to logs of widely varying diameter, such means being comprised of a hydraulic piston and cylinder unit 118 the piston rod 120 of which is connected by a clevis 122 and pin 124 to a flange 126 which is fixed to the beam 94 and projects outwardly therefrom above the splitting head 76. The cylinder 128 of the unit 118 is fixed by a clevis 130 and pin 132 to a flange 134 projecting outwardly from a horizontally extending beam 136 which forms part of the framework 38. The piston and cylinder unit 118 is controlled by a manually actuated valve 138 which enables the operator of the apparatus to raise or lower the splitting head 76 so that the splitting wedges are positioned at the desired location relative to the longitudinal axis of the logs being split.

Figure 4:
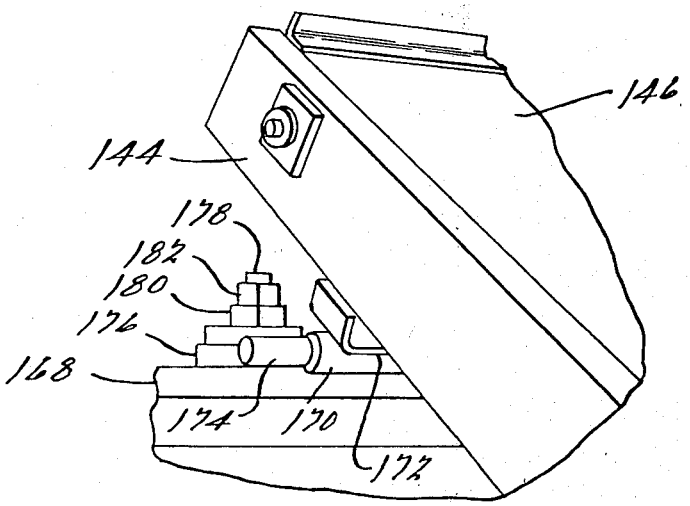
FIG. 4 is an enlarged perspective view of the upper end portion of the conveyor incorporated in the apparatus illustrated in FIGS. 1 and 2.

An inclined conveyor, generally designated 140, is provided for individually feeding logs (which have previously been cut to the desired length) to the open top 142 of the chute 30. As shown in FIGS. 1, 2 and 4, the conveyor 140 is comprised of a support 144 which carries a chain drive conveyor belt 146 having spaced, transversely extending barriers 148 defining compartments, such as 150, 152 and 154, each adapted to receive an individual log. The conveyor belt 146 is powered by a conventional hydraulic motor 156 driving a chain 158 entrained over sprockets 160 and 162. As shown in FIG. 6, the hydraulic motor 156 is controlled by a push button hydraulic valve 164 which is actuated by a bar 166 which is of predetermined length and which moves with the drive head 42 as the drive head 42 is reciprocated by the hydraulic ram 78.

In FIGS. 1, 2 and 4, the upper end portion of the conveyor support 144 is illustrated as supported in an inclined position by a horizontally extending beam 168 which forms part of the framework 38, and means is provided for connecting the upper left end portion of the conveyor support 144, as viewed in FIG. 4, to the beam 168 whereby compound or universal movement of the conveyor support 144 relative to the framework 38 is permitted so that the conveyor support 144 may be swung from the inclined position illustrated in FIGS. 1, 2 and 4 (wherein the longitudinal axis of the conveyor support 144 is substantially perpendicular to the longitudinal axis of the chassis 12) to a generally horizontal position wherein the conveyor support 144 overlies the chassis 12 and the longitudinal axis of the conveyor support 144 is substantially parallel to the longitudinal axis of the chassis 12. As shown in FIG. 4, such means for connecting the conveyor support 144 to the beam 168 is comprised of an elongate cylindrical tubular member 170 which extends transversely from side to side of the conveyor support 144 and which is fixed to the conveyor support 144 by generally channel shaped feet, such as 172, which are welded or otherwise fixed to both the tubular member 170 and the conveyor support 144. The tubular member 170 is circumposed on a cylindrical rod 174 which extends through the tubular member 170 and the left end portion of the cylindrical rod 174 is fixed, as by welding, to a pivot block 176 mounted for pivotal movement on a pivot pin 168 projecting upwardly from the beam 168, the pivot block 176 being retained by nuts 180 and 182 threadably engaging the upper end portion of the pivot pin 178. As shown in FIG. 1, the central portion of the conveyor support 144 is supported by an elongate roller 184 carried by the conveyor support 144, the roller 184 resting on and rotatably engaging a diagonal brace 186 the opposite ends of which are fixed to the framework 38 as at 188 and 190. With such a construction, when it is desired to swing the conveyor support 144 from the inclined position illustrated in FIGS. 1, 2 and 4 to the aforementioned generally horizontal position wherein the conveyor support 144 overlies the chassis 12 and the longitudinal axis of the conveyor support 144 is substantially parallel to the longitudinal axis of the chassis 12, for example for highway transportation purposes, the chain 158 is first disconnected from the sprocket 162. The conveyor support 144 may then be pivoted about the pivot pin 178 while the roller 184 moves up the brace 186 and the tubular member 170 simultaneously rotates relative to the cylindrical rod 174 to permit the required compound or universal movement of the conveyor support 144 relative to the framework 38.

Reciprocal movement of the hydraulic ram 78 is controlled by a reversing valve 192 carried by the framework 38, the reversing valve 192 being connected to the source of fluid pressure 28 and to a fluid reservoir 194 by suitable hydraulic lines. The reversing valve 192 is operated in a conventional manner by an angularly movable handle 196 which pivots about the longitudinal axis of the pin 198. A latch mechanism, generally designated 200, is provided which is mounted on an angle iron base 202 fixed to the framework 38 by an angle iron 204. The latch mechanism 200 includes a pair of latch plates 206 and 208 pivotally connected to the base 202 by a pivot pin 210, the latch plates 206 and 208 being retained by a washer 212 and a nut 214 threadably engaging the pivot pin 210. The latch plates 206 and 208 include inclined latch surfaces 216 and 218, respectively, selectively engagable with the handle 196 of the reversing valve 192. The latch plate 206 also includes an abutment surface 220 engaging an adjustable, resilient biasing member 222 carried by a flange 224 fixed to the base 202 and projecting outwardly therefrom. The latch plate 206 is thus biased in a clockwise direction by the member 222 against a stop 226 carried by a flange 228 also fixed to the base 202 and projecting outwardly therefrom. The latch plate 208 includes an abutment surface 230 engaging a resilient biasing member 232 carried by the flange 228 whereby the latch plate 208 is biased in a counter-clockwise direction by the member 232. The latch plates 206 and 208 also include integral fingers 234 and 236, respectively, the finger 236 being adapted to engage the adjacent edge of the flange 228 to limit the movement of the latch plate 208 in a counter-clockwise direction. An elongate chain 238 of predetermined length is provided, one end of the chain being fixed to the hydraulic ram 78 by a washer 240 mounted on a bolt 242 which is welded to the hydraulic ram 78. Such end of the chain is retained by a nut 244 threadably engaging the shank of the bolt 242. The opposite end of the chain 238 is attached to an eccentric pin 246 carried by the finger 236 of the latch plate 208 in radially spaced relationship with respect to the axis of the pivot pin 210, the chain being retained on the eccentric pin 246 by nuts 248 and 250 threadably engaging the pin 246.

An elongate tension coil spring 252 is also provided the unstressed length of which is less than the length of the chain 238. The spring 252 includes a hooked portion 254 at one end thereof which is hooked to the outer end portion of the handle 196 intermediate spaced radially extending washers 256 and 258 fixed to the handle to afford limited movement of the spring longitudinally of the handle. The opposite end of the spring 252 is provided with a hook portion 260 which is hooked to a bolt 262 welded to the hydraulic ram 78 so as to move therewith, the hook portion 260 being retained by nuts 264 and 266 threadably engaging the bolt 262. A generally L-shaped actuating member 268 is also provided, the member 268 having a flange 270 fixed to the ram 78, as by screws 272, and an upwardly projecting flange 274 engagable with the free end portion of the finger 234 of the latch plate 206 as the ram 78 moves toward the latch mechanism 200.

Figure 7:
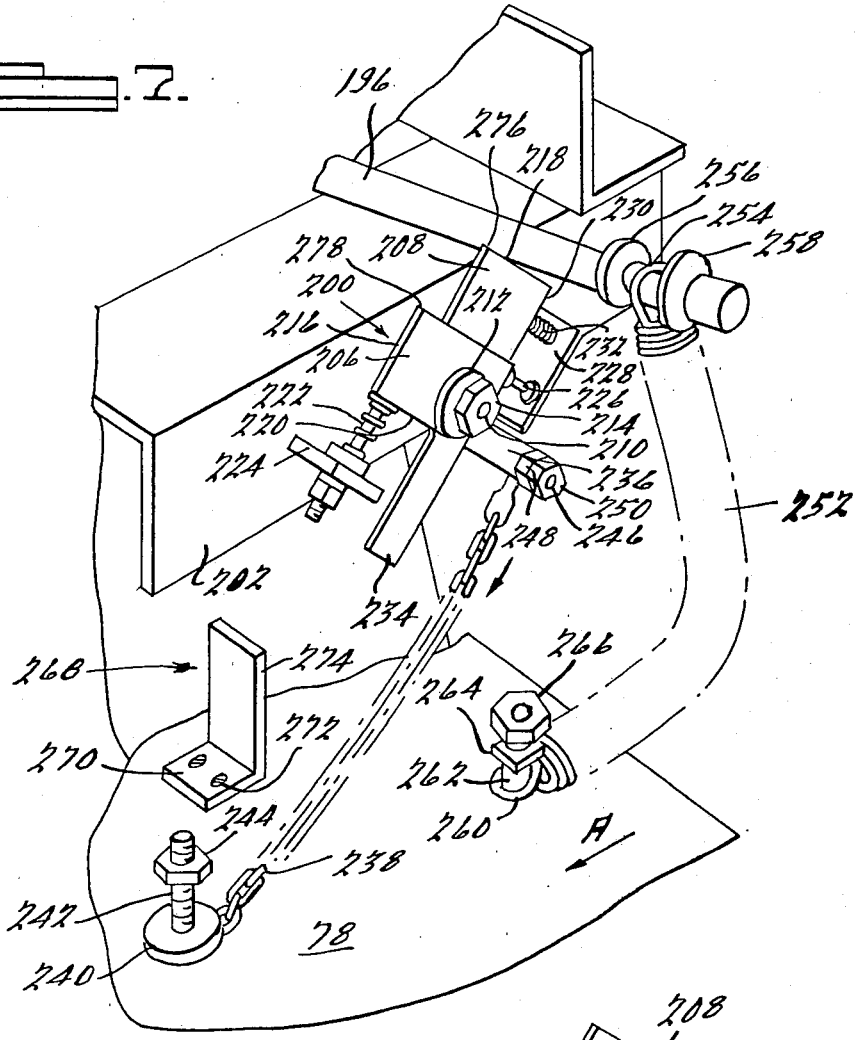
FIG. 7 is an enlarged view of a portion of the structure illustrated in FIG. 5.
Figure 8:
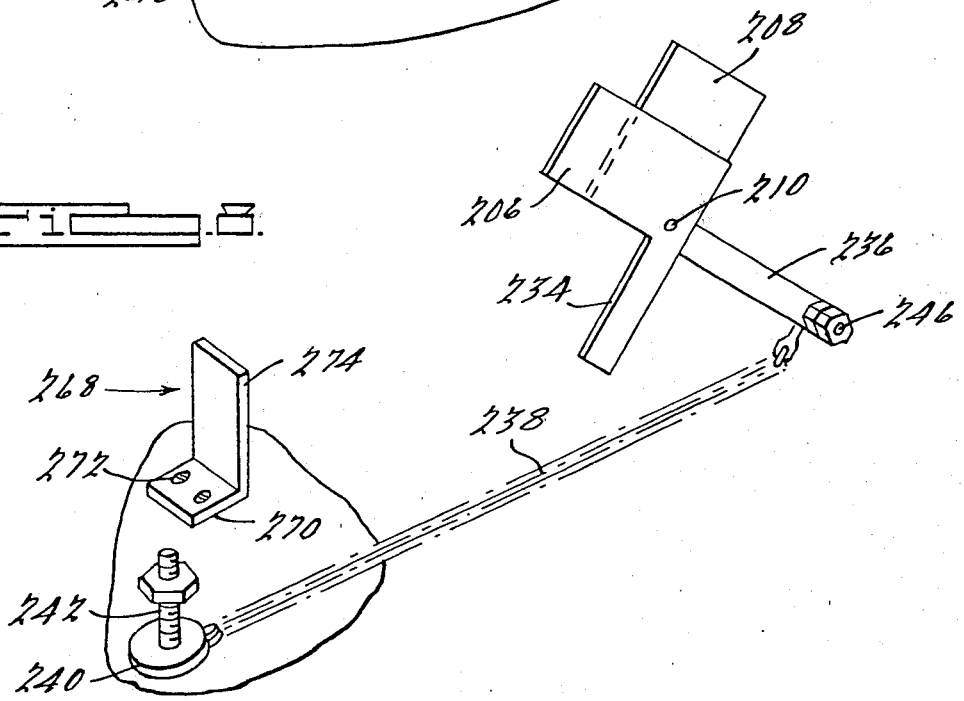
FIG. 8 is a schematic view of portions of the structure illustrated in FIGS. 5 and 7.

With such a construction, and assuming that the hydraulic ram 78 is moving to the left in the direction of the arrow A in FIG. 7, the spring 252 is stretched thereby resiliently biasing the handle 196 against the surface 218 on the latch plate 208, counter-clockwise rotation of the latch plate 208 being prevented by the finger 236 bearing against the adjacent edge of the flange 228. As previously mentioned, the chain 238 is of a predetermined length which is greater than the length of the spring 252 when the spring 252 is in the unstressed condition. The length of the chain 238 is such that when the hydraulic ram 78 reaches the point where it is desired to reverse the direction of movement of the hydraulic ram, the chain 238 pulls on the eccentric pin 246 so as to rotate the latch plate 208 about the pivot pin 210 against the biasing action of the resilient member 232. As the corner 276 of the latch plate moves below the periphery of the handle 196, the stressed spring 252 snaps the handle 196 of the reversing valve to the left, as viewed in FIG. 7, and over the corner 278 of the latch plate 206 so that the reversing valve reverses the hydraulic pressure applied to the hydraulic ram 78 to reverse the direction of movement of the hydraulic ram. As the hydraulic ram 78 reverses its direction of movement, tension on the chain 238 is reduced and the spring 252 biases the handle 196 against the abutment surface 216 of the latch plate 206, the latch plate 206 being biased in a clockwise direction against the stop 226 by the resilient member 222. Reversal of the direction of movement of the hydraulic ram 78 at the end of its forward stroke is accomplished when the flange 274 engages the finger 234 of the latch plate 206 so as to rotate the latch plate 206 in a counter-clockwise direction about the pin 210. When the corner 278 of the latch plate 206 moves below the periphery of the handle 196, the spring 252 snaps the handle 196 over the corners 278 and 276 of the latch plates so that the reversing valve reverses the hydraulic pressure applied to the ram 78. As the ram reverses its direction, the spring 252 biases the handle 196 against the surface 218 of the latch plate 208, and the cycle is repeated in the manner previously described.

While a preferred embodiment of the invention has been illustrated and described, it will be understood that various changes and modifications may be made without departing from the spirit of the invention.

What is claimed is:

1. A log splitting apparatus comprising, in combination, a framework, an open top guide chute supported by said framework and defining a generally V-shaped passageway open at least at one end thereof, a drive member mounted for reciprocal movement in the passageway defined by said chute, said drive member being of stepped configuration and of progressively decreasing thickness, a log splitting head supported by said framework adjacent said one end of said chute, said splitting head having a log splitting wedge directed toward said one end of said chute, and hydraulic ram means operable to advance and retract said drive member in the passageway defined by said chute whereby said drive member successively forces individual logs disposed in the passageway defined by said chute against said log splitting head.

2. The combination as set forth in claim 1 including conveyor means supported by said framework and adapted to convey logs individually to the open top of said chute.

3. The combination as set forth in claim 1, said splitting head including multiple log splitting wedges disposed in angular relationship with respect to each other and directed toward said one end of said chute.

4. The combination as set forth in claim 1 including valve means effective to automatically advance and retract said hydraulic ram means.

5. The combination as set forth in claim 2 including a hydraulic motor for advancing said conveyor means, and means controlling the actuation of said hydraulic motor and operable as a function of the movement of said hydraulic ram means to advance said conveyor means incrementally.

6. The combination as set forth in claim 1 including means for raising and lowering said log splitting wedge relative to the apex of said chute.

7. The combination as set forth in claim 4, said valve means including a reversing handle, a latch mechanism controlling the actuation of said reversing handle, said latch mechanism comprising a pair of latch plates mounted for pivotal movement about a common axis and having abutment surfaces selectively engageable with said reversing handle, resilient means biasing said latch plates in opposite angular directions about said common axis, spring means actuated by said ram means and operable to force said handle alternately against said abutment surfaces, and means fixed to said ram means and operable to selectively disengage said abutment surfaces from said handle.

8. The combination as set forth in claim 7 including means limiting the angular movement of said latch plates.

9. A log splitting apparatus comprising in combination, a framework, an open top, generally V-shaped guide chute supported by said framework and defining a generally V-shaped passageway open at least one end thereof, a drive member mounted for reciprocal movement in the passageway defined by said chute, said drive member being of stepped configuration and of progressively decreasing thickness in a direction toward the apex of said chute, a log splitting head supported by said framework adjacent said one end of said chute, said splitting head having a log splitting wedge directed toward said one end of said chute, and hydraulic ram means operable to advance and retract said drive member in the passageway defined by said chute whereby said drive member successively forces individual logs disposed in the passageway defined by said chute against said log splitting head, and conveyor means supported by said framework and adapted to convey logs individually to the open top of said chute.

10. The combination as set forth in claim 9, said splitting head including multiple log splitting wedges disposed in angular relationship with respect to each other and directed toward said one end of said chute.

11. The combination as set forth in claim 10 including valve means effective to automatically advance and retract said hydraulic ram means.

12. The combination as set forth in claim 11 including a hydraulic motor for advancing said conveyor means, and means controlling the actuation of said hydraulic motor and operable as a function of the movement of said hydraulic ram means to advance said conveyor means incrementally.

13. The combination as set forth in claim 12 including means for raising and lowering said log splitting wedges relative to the apex of said chute.

14. The combination as set forth in claim 13, said valve means including a reversing handle, a latch mechanism controlling the actuation of said reversing handle, said latch mechanism comprising a pair of latch plates mounted for pivotal movement about a common axis and having abutment surfaces selectively engageable with angularly spaced surfaces on said reversing handle, resilient means biasing said latch plates in opposite angular directions about said common axis, spring means actuated by said ram means and operable to force said augularly spaced surfaces on said handle alternately against said abutment surfaces, and means fixed to said ram means and operable to selectively disengage said abutment surfaces from said augularly spaced surfaces on said handle, said last mentioned means including an elongate tension member having one end thereof fixed to said ram means and the other end thereof fixed to one of said latch plates.

15. The combination as set forth in claim 14 including means limiting the angular movement of said latch plates.

16. The combination as set forth in claim 15 including an actuating member fixed to said ram means and engageable with the other of said latch plates.

17. A self-contained, mobile log splitting apparatus comprising, in combination, a framework, a guide chute supported by said framework and defining a generally V-shaped passageway open at each end and at the top thereof, a drive member mounted for reciprocal movement in the passageway defined by said chute, said drive member being of stepped configuration and of progressively decreasing thickness in a direction toward the apex of said chute, a log splitting head supported by said framework adjacent one end of said chute, said splitting head having a plurality of log splitting wedges directed toward said one end of said chute, hydraulic ram means operable to advance and retract said drive member in the passageway defined by said chute, a hydraulic pump mounted on said framework and operatively connected to said hydraulic ram means, an internal combustion engine mounted on said framework and powering said hydraulic pump, and wheel means supporting said framework.

18. The combination as set forth in claim 17 including conveyor means supported by said framework and adapted to convey logs individually to the open top of said chute.

19. The combination as set forth in claim 18 including means connecting one end portion of said conveyor to said framework for compound movement of said conveyor relative to said framework.

20. The combination as set forth in claim 19 including a hydraulic motor effective to advance said conveyor means, and means controlling the actuation of said hydraulic motor as a function of the movement of said hydraulic ram means so as to advance said conveyor means incrementally.

21. The combination as set forth in claim 20 including means for raising and lowering said log splitting wedges relative to the apex of said chute.

22. The combination as set forth in claim 21, said valve means including a reversing handle, a latch mechanism controlling the actuation of said reversing handle, said latch mechanism comprising a pair of latch plates mounted for pivotal movement about a common axis and having abutment surfaces selectively engageable with spaced surfaces on said reversing handle, resilient means biasing said latch plates in opposite angular directions about said common axis, spring means actuated by said ram means and operable to force said spaced surfaces on said handle alternately against said abutment surfaces, disengaging means fixed to said ram means and operable to selectively disengage said abutment surfaces from said spaced surfaces on said handle, said disengaging means including an elongate tension member having one end thereof fixed to said ram means and the other end thereof fixed to one of said latch plates and also including an actuating member fixed to said ram means and engageable with the other of said latch plates.

23. The combination as set forth in claim 22 including means limiting the angular movement of said latch plates.

* * * * *